US007461915B2

(12) United States Patent
Koga et al.

(10) Patent No.: US 7,461,915 B2
(45) Date of Patent: Dec. 9, 2008

(54) INKJET RECORDING APPARATUS

(75) Inventors: Yuji Koga, Nagoya (JP); Takatoshi Takemoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 500 days.

(21) Appl. No.: 11/275,838

(22) Filed: Jan. 31, 2006

(65) Prior Publication Data

US 2006/0170969 A1 Aug. 3, 2006

(30) Foreign Application Priority Data

Jan. 31, 2005 (JP) ..... 2005-024425

(51) Int. Cl.
*B41J 2/165* (2006.01)
*B41J 2/175* (2006.01)

(52) U.S. Cl. ..... 347/29; 347/30; 347/32; 347/33; 347/86; 347/23

(58) Field of Classification Search ..... 347/29, 347/30, 32, 33, 23, 86
See application file for complete search history.

(56) References Cited

U.S. PATENT DOCUMENTS 7,364,279 B2 * 4/2008 Usui et al. ..... 347/84

FOREIGN PATENT DOCUMENTS

| | | | |
|---|---|---|---|
| JP | 2003063034 | A | 3/2003 |
| JP | 2003266745 | A | 9/2003 |
| JP | 2004255861 | A | 9/2004 |
| WO | 2004069545 | A1 | 8/2004 |

* cited by examiner

*Primary Examiner*—Shih-Wen Hsieh
(74) *Attorney, Agent, or Firm*—Baker Botts L.L.P.

(57) ABSTRACT

An inkjet recording apparatus includes a recording head, a carriage, a movable body, a moving mechanism, and a relative position controller. The recording head is provided with a sub-tank and an ejection nozzle. The sub-tank includes an air discharging unit having a communication hole that allows communication of the interior of the sub-tank with atmospheric air. The movable body includes an open-close switching member so as to switch a state of the communication hole corresponding to a change of the relative position of a nozzle surface with respect to the movable body. The relative position controller controls the moving mechanism for moving the movable body and switches the state of the inkjet recording apparatus into a recording mode, a discharge performance recovery mode and an air discharge mode.

3 Claims, 6 Drawing Sheets

FIG.3A FOR RECORDING
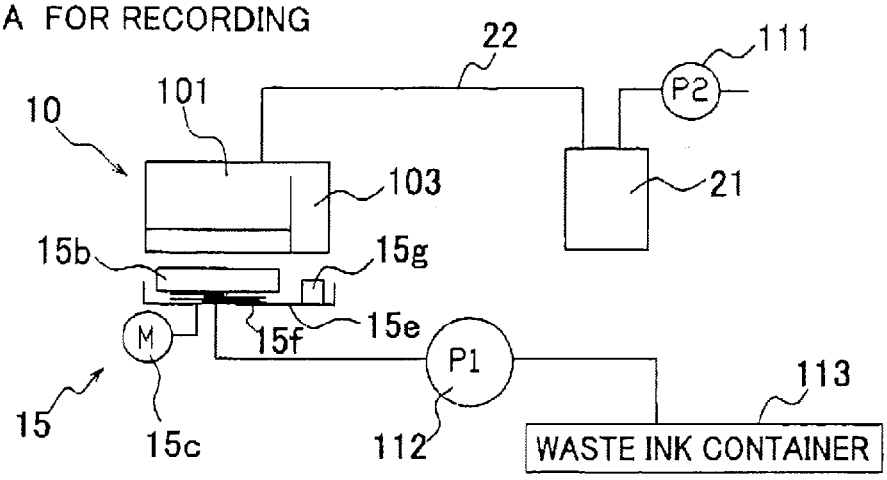
FIG.3B FOR DISCHARGE PERFORMANCE RECOVERY/ STANDBY
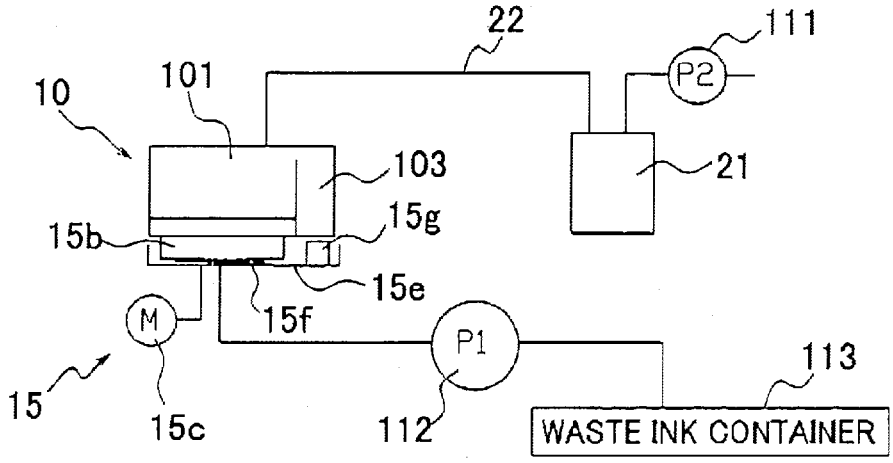
FIG.3C FOR AIR DISCHARGE
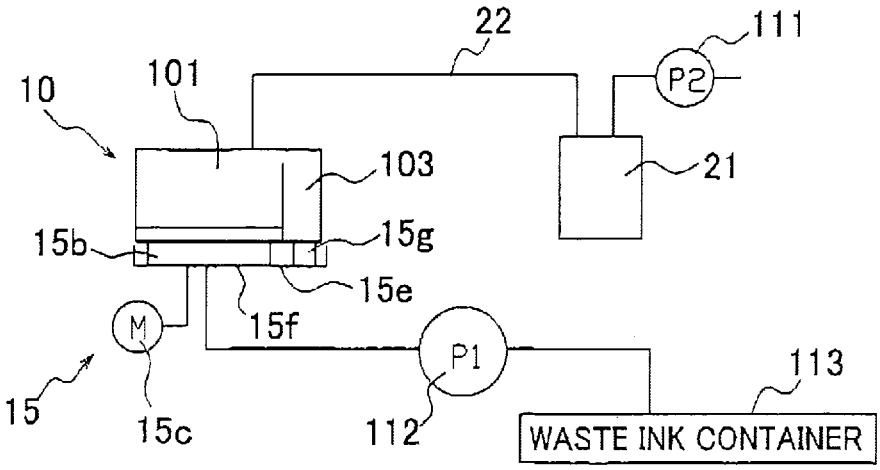

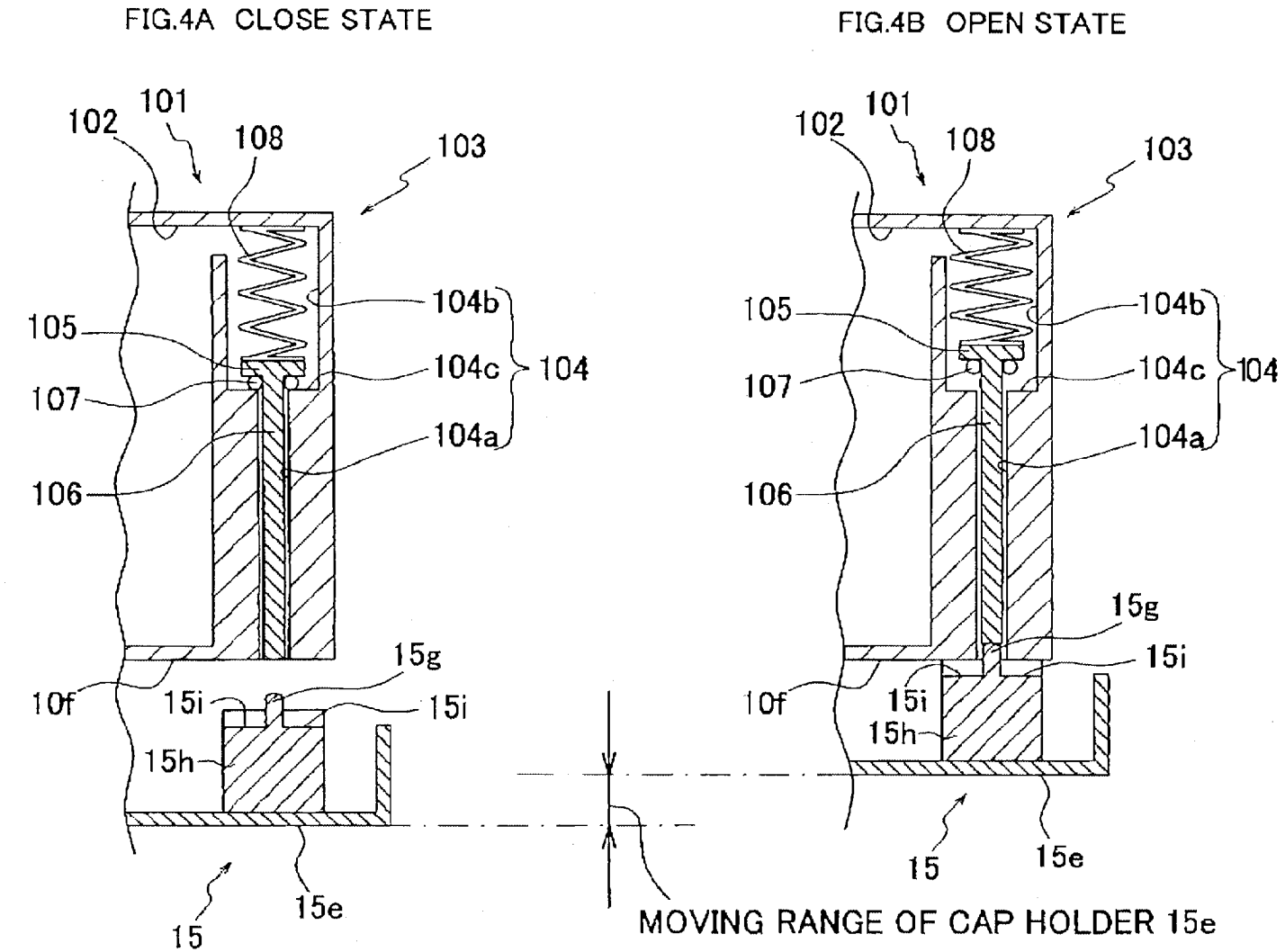
FIG.4B OPEN STATE
FIG.4A CLOSE STATE
MOVING RANGE OF CAP HOLDER 15e
101
102
103
104
104a
104b
104c
105
106
107
108
10f
15
15e
15g
15h
15i FIG.6A FOR RECORDING
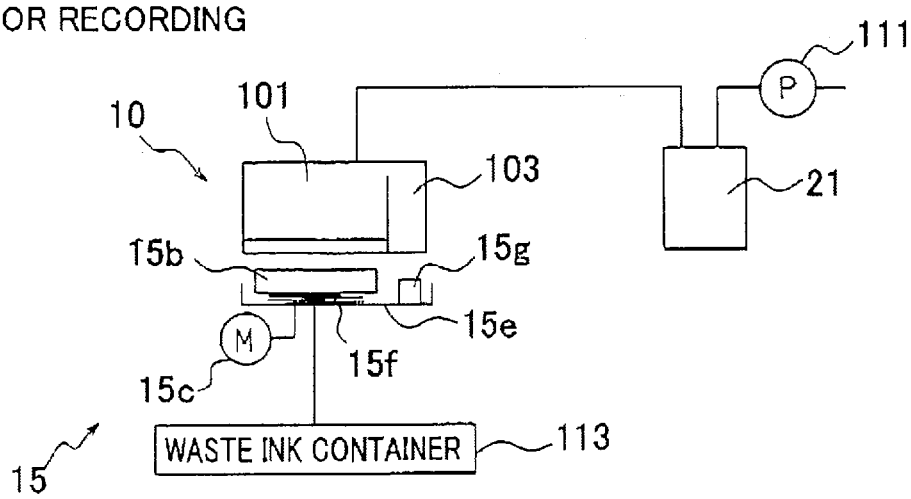
FIG.6B FOR DISCHARGE PERFORMANCE RECOVERY/ STANDBY
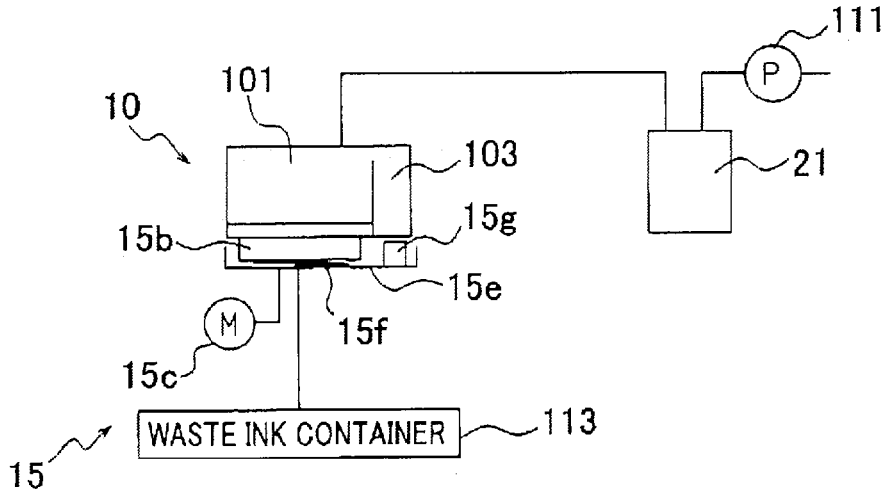
FIG.6C FOR AIR DISCHARGE
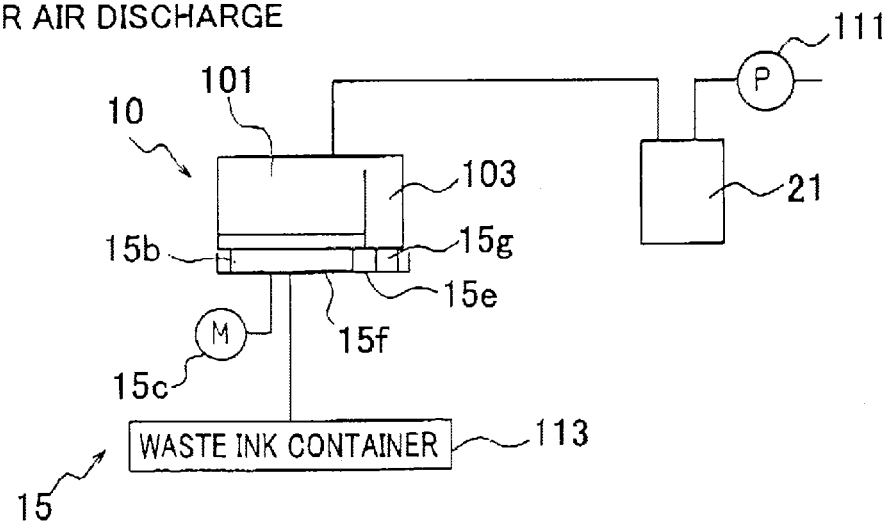

INKJET RECORDING APPARATUS

CROSS-REFERENCE TO RELATED APPLICATIONS

This application claims the benefit of Japanese Patent Application No. 2005-24425 filed Jan. 31, 2005 in the Japan Patent Office, the disclosure of which is incorporated herein by reference.

BACKGROUND

This invention relates to a technique for providing an inkjet recording apparatus wherein the inkjet recording apparatus can be switched into different states for recording, purging, standby, and air discharge, with a simple structure.

A conventional inkjet recording apparatus has an ink supply system. For example, in this system, ink is supplied through tubes from a main tank to a sub-tank provided on a carriage. This type of inkjet recording apparatus comprises a carriage and a main tank. The carriage carries a recording head and a sub-tank thereon. The recording head ejects ink from ejection nozzles and conducts recording on a recording medium. The sub-tank stores ink that is supplied to the recording head. The main tank stores ink that is supplied to the sub tank. When the ink in the sub-tank is decreased, additional ink is supplied to the sub-tank from the main tank.

Some of the inkjet recording apparatus of this type have a maintenance mechanism. Specifically, this type of inkjet recording apparatus is provided with an air-bubble remover at a standby position of the carriage. In this apparatus, accumulated air bubbles in an ink tank are removed by the air-bubble remover as follows. First, a lifting body is lifted by a horizontal movement of a cam. A valve rod is pushed up by a release rod. Suction paths respectively communicated with air-bubble reservoirs are opened by an opening-closing valve. Consequently the surfaces of the ink in the respective air-bubble reservoirs are raised by the positive pressure provided by an air pump. The accumulated air bubbles are discharged through the opening-closing valve while the air-bubble reservoirs are opened by the valve.

However, in the structure of the inkjet recording apparatus as described above, the lifting body and the release rod are respectively lifted by different lifting mechanisms. This kind of structure increases the number of components used in the inkjet recording apparatus. Additionally, these lifting mechanisms need to be controlled independently from each other. Therefore, the structure of the inkjet recording apparatus becomes complicated.

The present invention was made in consideration of the above and other inconveniences. It would be desirable that an inkjet recording apparatus is provided with a technique wherein the state of the inkjet recording apparatus is changed for recording, purging, standby, and air discharge, through a simple structure.

SUMMARY

In one aspect of the present invention, an inkjet recording apparatus includes a recording head, a carriage, a movable body, a moving mechanism, and a relative position controller. The recording head has a sub-tank storing ink and an ejection nozzle for conducting image recording on a recording medium by selectively ejecting ink from inside the sub-tank. The carriage is equipped with the recording head and is capable of being reciprocated in a direction perpendicular to the conveyance direction of the recording medium. The movable body can cover a nozzle surface for the ejection nozzle of the recording head. The moving mechanism can change the relative position of the nozzle surface with respect to the movable body by moving the movable body The relative position controller controls the moving mechanism for moving the moving body so as to change the relative position of the nozzle surface with respect to the movable body. The sub-tank is provided with an air discharging unit having a communication hole that allows communication of the interior of the sub-tank with the atmospheric air. The movable body is disposed so as to face the air discharging unit of the sub-tank. The movable body is provided with an open-close switching member so as to switch the state of the communication hole between an open state and a close state corresponding to a change of the relative position of the nozzle surface with respect to the movable body. The relative position controller changes the state of the inkjet recording apparatus into: a recording mode wherein the nozzle cap is located away from the nozzle surface and the communication hole is closed so as to allow image recording on a recording medium; a discharge performance recovery mode wherein the nozzle surface is covered by the nozzle cap and the communication hole is closed so as to allow the recovery of the discharge performance of the recording head; and an air discharge mode wherein the nozzle surface is covered by the nozzle cap and the communication hole is opened so as to allow the discharge of air from interior of the sub-tank.

BRIEF DESCRIPTION OF THE DRAWINGS

The invention will now be described below, by way of example, with reference to the accompanying drawings, in which:

FIGS. 3A to 3C are schematic views showing structures of a recording head and a maintenance mechanism according to a first embodiment of the present invention in which FIG. 3A shows a recording state of the printer, FIG. 3B shows a discharge performance recovery state, and FIG. 3C shows an air discharge state;

FIGS. 4A and 4B are schematic views showing structures of an air discharging unit of the recording head and a protruding portion of the maintenance mechanism according to a first embodiment in which FIG. 4A shows a close state of the air discharging unit, and FIG. 4B shows an open state thereof;

FIGS. 6A to 6C are schematic views showing structures of a recording head and a maintenance mechanism according to the second embodiment of the present invention in which FIG. 6A shows a recording state of the printer, FIG. 6B shows a discharge performance recovery state, and FIG. 6C shows an air discharge state.

DETAILED DESCRIPTION OF THE PREFERRED EMBODIMENT

First Embodiment

The present embodiment is one example wherein the present invention is applied to a multifunction apparatus which serves as a printer, a copier, a scanner, a facsimile, a telephone and the like.

[Structure of Multifunction Apparatus 1]

Figure 1:
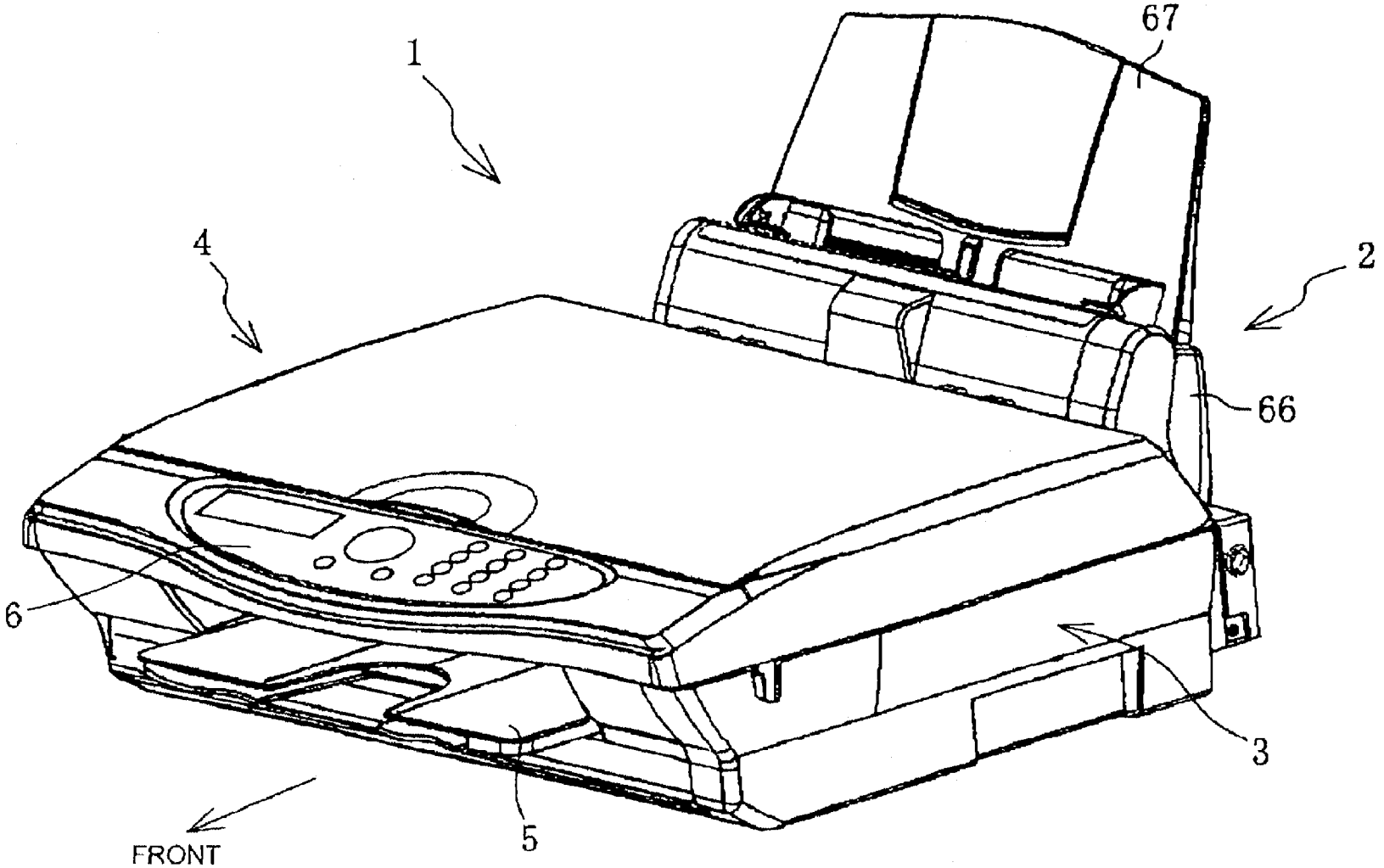
FIG. 1 is a perspective view showing a multifunction apparatus that works as a printer, a copier, a scanner, a facsimile, and a telephone.

Referring to FIG. 1, a multifunction apparatus 1 according to the present embodiment comprises a paper supply unit 2, an inkjet printer 3 and a reading unit 4. The paper supply unit 2 is provided at the rear end of the multifunction apparatus 1. The inkjet printer 3 is provided in front of the lower portion of the paper supply unit 2. The reading unit 4 is provided on top of the printer 3 for reading an image as a copier, a facsimile or a scanner. The multifunction apparatus 1 is further provided with a discharge tray 5 in front of the printer 3, and an operation panel 6 at the front end of the upper surface of the reading unit 4.

The paper supply unit 2 comprises an inclined wall portion 66 that supports paper in an inclined state, and an extendable paper guide plate 67 that is detachably attached to the inclined wall portion 66 so as to guide paper. A plurality of sheets of paper can be stored in the paper supply unit 2. The inclined wall portion 66 incorporates a paper supply motor 65 (not shown in FIG. 1, see FIG. 5) and a paper feed roller (not shown). In the paper supply unit 2, the paper feed roller, which is rotated by the driving force of the paper supply motor 65, conveys paper toward the printer 3.

[Structure of Printer 3]

Figure 2:
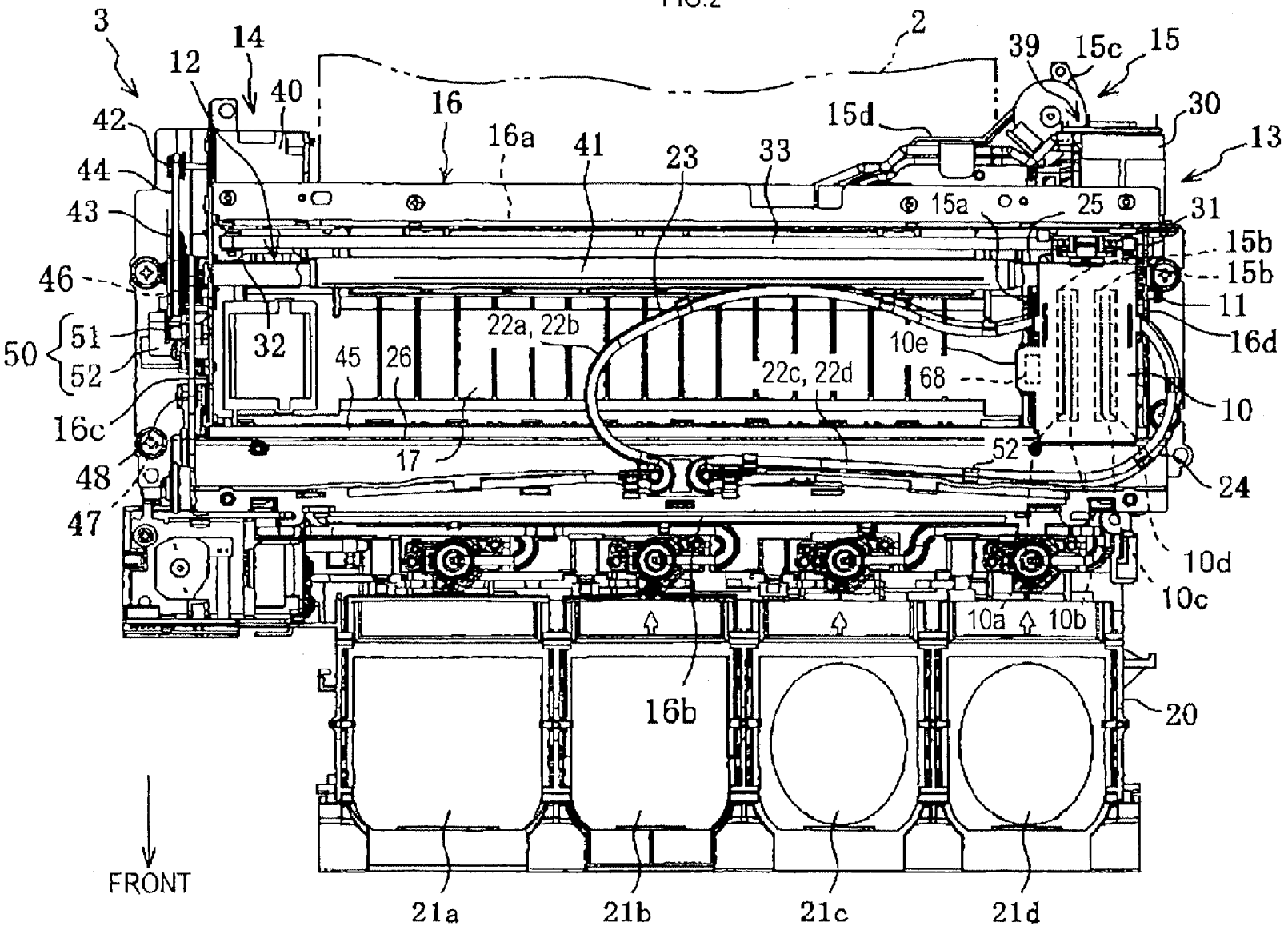
FIG. 2 is a plan view showing an internal structure of the printer included in the multifunction apparatus.

As shown in FIG. 2, the printer 3 comprises a recording head 10, a carriage 11, a guide mechanism 12, a carriage moving mechanism 13, a paper conveyance mechanism 14 and a maintenance mechanism 15. The carriage 11 carries the recording head 10 thereon. The guide mechanism 12 supports the carriage 11 so that the carriage 11 can move reciprocally in the left-to-right direction as a scanning direction. The carriage moving mechanism 13 moves the carriage 11 in the left-to-right direction. The paper conveyance mechanism 14 conveys paper supplied by the paper supply unit 2. The maintenance mechanism 15 is provided for maintaining the recording head 10.

The printer 3 is provided with a frame 16 in a rectangular parallelepiped shape that is large in the left-to-right direction and small in the up-and-down direction. The guide mechanism 12, the carriage moving mechanism 13, the paper conveyance mechanism 14 and the maintenance mechanism 15 are attached to the frame 16. Furthermore, the recording head 10 and the carriage 11 are disposed inside of the frame 16 so as to be movable in the left-to-right direction.

The frame 16 includes a rear plate 16*a* and a front plate 16*b*. A paper introducing opening and a paper discharging opening (not shown) are respectively formed in the rear plate 16*a* and the front plate 16*b*. Paper supplied by the paper supply unit 2 is introduced into the frame 16 via the paper introducing opening, conveyed to the front of the frame 16 by the paper conveyance mechanism 14, and discharged through the paper discharging opening onto the discharge tray 5 (see FIG. 1) located on the front of the multifunction apparatus 1. A black platen 17, having a plurality of ribs, is mounted on the bottom surface of the frame 16. The recording head 10 performs recording (image forming) on paper inside of the frame 16 as the paper moves over the black platen 17.

A cartridge holder 20 is provided in front of the frame 16. The cartridge holder 20 includes ink cartridges 21*a*-21*d*, one for each of the four colors (black, cyan, yellow and magenta) of ink. The ink cartridges 21*a*-21*d* are connected to the recording head 10 via four flexible ink tubes 22*a*-22*d* that pass through the frame 16. Each of the four colors of inks is supplied to the recording head 10 when pressure is applied by a pressure pump 111 (not shown in FIG. 2, see FIG. 3A).

There are left and right FPCs (Flexible Print Circuits) 23 and 24 provided inside of the frame 16. The left FPC 23 extends integrally with two of the ink tubes 22*a* and 22*b* and is connected to the recording head 10. The right FPC 24 extends integrally with two of the ink tubes 22*c* and 22*d* and is also connected to the recording head 10. FPC 23 and 24 are provided with a plurality of signal lines that electrically connect the recording head 10 to a control processing device 70 (not shown in FIG. 2) described later.

The guide mechanism 12 has a guide shaft 25 and a guide rail 26. The guide shaft 25 extends in the left-to-right direction in the rear part of the frame 16. The left and right ends of the guide shaft 25 are respectively coupled with a left plate 16*c* and a right plate 16*d* of the frame 16. The guide rail 26 extends in the left-to-right direction in the front part of the frame 16. The rear end of the carriage 11 is fitted over the guide shaft 25 so as to be capable of sliding along the guide shaft 25, while the front end of the carriage 11 is engaged with the guide rail 26 and is capable of sliding along the guide rail 26.

The carriage moving mechanism 13 includes a carriage motor 30, a drive pulley 31, a follow pulley 32 and a belt 33. The carriage motor 30 is mounted on the frame 16 at the rear side of the rear plate 16*a* on the right end and facing to the front. The drive pulley 31 is driven to rotate by the carriage motor 30. The follow pulley 32 is rotatably supported on the left end of the rear plate 16*a*. The belt 33 is looped around the pulleys 31 and 32 and fixed to the carriage 11. A carriage conveyance encoder 39 is disposed on the carriage motor 30 for detecting the moving amount (moving position) of the carriage 11 (the recording head 10).

The paper conveyance mechanism 14 includes a paper conveyance motor 40, a registration roller 41, a drive pulley 42, a follow pulley 43, and a belt 44. The paper conveyance motor 40 is mounted so as to face leftward on a portion of the left plate 16*c* that protrudes further rearward beyond the rear plate 16*a*. The registration roller 41 extends in the left-to-right direction in the frame 16 below the guide shaft 25. The left and right ends of the registration roller 41 are rotatably supported in the left plate 16*c* and the right plate 16*d*, respectively. The drive pulley 42 is driven to rotate by the paper conveyance motor 40. The follow pulley 43 is coupled to the left end of the registration roller 41. The belt 44 is looped around the pulleys 42 and 43. When the paper conveyance motor 40 is driven, the registration roller 41 is rotated and conveys paper in the rear-to-front direction. While the registration roller 41 is emphasized in FIG. 2, the registration roller 41 is actually disposed beneath the guide shaft 25.

The paper conveyance mechanism 14 furthermore includes a discharge roller 45, a follow pulley 46, a follow pulley 47 and a belt 48. The discharge roller 45 extends in the left-to-right direction in the front section of the frame 16. The left and right ends of the discharge roller 45 are respectively rotatably supported by the left plate 16*c* and the right plate 1*d*. The follow pulley 46 is integrally provided with the follow pulley 43. The follow pulley 47 is coupled to the left end of the discharge roller 45. The belt 48 is looped around the pulleys 46 and 47. When the paper conveyance motor 40 is driven, the discharge roller 45 is rotated and discharges paper toward the discharge tray 5 in the front of the multifunction apparatus 1.

An encoder disc 51 is fixed to the follow pulley 43. A photo interrupter 52, having a light-emitting portion and a light-receiving portion, is mounted on the left plate 16*c* so that the encoder disk 51 is interposed between the light-emitting portion and the light-receiving portion. The encoder disc 51 and the photo interrupter 52 constitute a paper conveyance encoder 50. The control processing device 70 described later controls the driving of the paper conveyance motor 40 based on the detection signals from the paper conveyance encoder 50 (more specifically, the photo interrupter 52).

As shown in FIG. 2, a media sensor 68 is mounted on the left end of the recording head 10 for detecting the leading edge, trailing edge, and side edges of a paper media. The media sensor 68 is a reflective optical sensor that includes a light-emitting portion (light-emitting element) and a light-receiving portion (light-receiving element). The media sensor 68 is mounted on a sensor mounting portion 10*e* and is facing downward (perpendiculary into the plane of FIG. 2). The sensor mounting portion 10*e* protrudes from the left side of the recording head 10.

A registration sensor 69 (see FIG. 5) is disposed upstream (to the rear side) of the media sensor 68 in the paper conveyance direction. The registration sensor 69 is a sensor on the upstream side that can detect the existence of a paper media, as well as the leading end and the trailing end of the paper. Specifically, the registration sensor 69 is attached to the front end of an upper cover that forms a conveyance path in the paper supply unit 2.

The registration sensor 69 may be a mechanical sensor having a probe, a photo interrupter, and a torsion spring. The probe protrudes into the paper conveyance path. When the probe is contacted by the paper that is being conveyed, the probe is rotated. The photo interrupter includes a light-emitting portion and a light-receiving portion, and detects the rotation of the probe. The torsion spring urges the probe into the paper conveyance path. A shielding portion is integrally provided on the probe. When the probe is rotated by the paper, which is being conveyed, the shielding portion is disposed outside of the area between the light-emitting portion and the light-receiving portion of the photo interrupter. Hence, light is transmitted from the light-emitting portion to the light-receiving portion, and the registration sensor 69 is in an ON state. However, when paper is not being conveyed, the probe is urged into the paper conveyance path by the torsion spring. The shielding portion becomes positioned between the light-emitting portion and the light-receiving portion of the photo interrupter. Consequently, the transmission of light from the light-emitting portion to the light-receiving portion is interrupted, and the registration sensor 69 is placed in an OFF state.

[Structure of Recording Head 10]

As shown in FIG. 2, the recording head 10 is provided with four sets of ink nozzles 10*a*-10*d* that point downward. Paper is printed by the ejection of four colors of ink through these sets of ink nozzles 10*a*-10*d*. Since the four sets of ink nozzles 10*a*-10*d* are disposed on the bottom side of the recording head 10, the positions of the ink nozzles 10*a*-10*d* are represented by dotted lines in FIG. 2.

Each of the ink nozzles 10*a*-10*d* constitutes a plurality (ex. 150 pieces) of ink nozzles (not shown) which are aligned in the paper conveyance direction and eject the same color of ink. The ink nozzles 10*a*-10*d* are disposed in order from the nozzle 10*a* to the nozzle 10*d* in the moving direction of the carriage 11.

The recording head 10 incorporates sub-tanks 101*a*-101*d* (represented by "sub-tank 101" in FIG. 3A) containing the four colors of ink. For each of the four colors, each of the sub-tanks 101*i*-101*d* is connected to one of the sets of ink nozzles 10*a*-10*d* via tubes or the like. Respective colors of ink can be supplied from the sub-tanks 101*a*-101*d* to the ink nozzles 10*a*-10*d*. Each of the sub-tanks 101*a*-101*d* has the same general structure. Therefore, only one of the sub-tanks containing a specific color of ink will be described hereinafter and is referred to as "sub-tank 101".

As shown 101 FIGS. 4A and 4B, the sub-tank 101 is provided with a tank body 102 that stores ink and an air discharging unit 103 for discharging the air accumulated inside of the tank body 102 to the outside. The air discharging unit 103 comprises a communication hole 104, a valve body 106, a valve rod 106, packing 107, and a spring device 108. The communication hole 104 communicates the tank body 102 of the sub-tank 101 with the outside air. The structure of the air discharging unit 103 having the valve body 105, the valve rod 106, the packing 107, and the spring device 108, is for switching the communication state of the communication hole 104 and the outside air.

The communication hole 104 comprises a lower communication hole 104*a* and an upper communication hole 104*b*. The lower communication hole 104*a* is communicated with the bottom surface 10*f* of the recording head 10. The upper communication hole 104*b* is communicated with the interior of the tank body 102. The communication hole 104 allows communication between the tank body 102 and the bottom surface 10*f* of the recording head 10. The diameter of the lower communication hole 104*a* is smaller than the diameter of the upper communication hole 104*b* disposed near the tank body 102. A flat abutment portion 104*c* is formed in an area inside of the communication hole 104, where the upper communication hole 104*b* transitions to the lower communication hole 104*a*. The packing 107 abuts on the abutment portion 104*c*.

The valve rod 106, having smaller diameter than the diameter of the valve body 105, is integrally formed on the bottom end of the valve body 105. The valve rod 106 is inserted into the lower communication hole 104*a* from an open end thereof facing the upper communication hole 104*b*. The packing 107, such as an O-ring for sealing, is attached to the valve rod 106. The packing 107 abuts on the bottom surface of the valve body 105. The bottom end of the valve rod 106 extends to the vicinity of the bottom opening of the lower communication hole 104*a*. The spring device 108, such as a coil spring, is disposed inside of the upper communication hole 104*b* for constantly pressing the valve body 105 downward.

The air discharging unit 103 constituted as above works as follows. When the packing 107 is pressed against the abutment portion 104*c* in the communication hole 104 by the urging of the spring device 108, the communication is blocked between the lower communication hole 104*a* and the upper communication hole 104*b*. Therefore, the outside air is shut out from the tank body 102 of the sub-tank 101 (see FIG. 4A). On the other hand, when a protruding portion 15*g* of the maintenance mechanism 15, which will be described later, is lifted so as to push the valve rod 106 up against the urging of the spring device 108, the packing 107 is moved away from the abutment portion 104*c* in the communication hole 104. Consequently, the lower communication hole 104*a* and the upper communication hole 104*b* are communicated with each other) and the inside of the tank body 102 of the sub-tank 101 is communicated with the outside air (see FIG. 4B).

[Structure of Maintenance Mechanism 15]

As shown in FIG. 2, the maintenance mechanism 15 comprises a wiper 15*a*, two caps 15*b* and a drive motor 15*c*. The wiper 15*a* wipes the head surface of the recording head 10. Each of the two caps 15*b* is capable of sealing two sets of ink nozzles among the sets of ink nozzles 10*a*-10*d*. The drive motor 15*c* drives both of the wiper 15*a* and the caps 15*b*. The wiper 15*a*, the caps 15*b*, and the drive motor 15*c*, are disposed on an attachment plate 15*d*. The attachment plate 15*d* is fixed in the right portion on the bottom plate of the frame 16 from below the bottom plate. Since the caps 15*b* are disposed beneath the recording head 10, the caps 15*b* are shown with dotted lines in FIG. 2 so as to show the disposition of the caps 15*b* in a perspective manner. The drive motor 15*c* supports the caps 15*b* by means of a movable cap holder 15*e* as shown in FIG. 3A. The caps 15*b* are attached to the cap holder 15*e* via an elastic member 15*f*. The cap holder 15*e* is disposed so as to face the recording head 10 when the recording head 10 is positioned above the maintenance mechanism 15.

The aforementioned protruding portion 15*g* is disposed on the top surface of the cap holder 15*e* so as to oppose the communication hole 104 of the recording head 10 when the recording head 10 is positioned above the maintenance mechanism 15. The protruding portion 15*g* is disposed so as to change the state of the communication hole 104 between an open state and a close state by pressing the valve rod 106. The diameter of the leading end of the protruding portion 15*g* is smaller than the inner diameter of the lower communication hole 104*a*. The protruding portion 15*g* is inserted into the lower communication hole 104*a* when the recording head 10 is positioned above the maintenance mechanism 15 and the cap holder 15*e* is lifted by the driving force of the drive motor 15*c*. The protruding portion 15*g* is supported by the cap holder 15*e* by means of a supporting body 15*h*. A bleeder groove 15*i* is formed on top of the supporting body 15*h*. The communication hole 104 is communicated with the outside air via the bleeder groove 15*i* when the protruding portion 15*g* is inserted into the lower communication hole 104*a*. Instead of providing the bleeder groove 15*i*, the protruding portion 15*g* may be formed longer so that a gap is formed between the supporting body 15*h* and the bottom surface 10*f* of the recording head 10 when the protruding portion 15*g* is inserted into the lower communication hole 104*a*. Owing to this gap, the communication hole 104 is communicated with the outside air. Moreover, because of the gap, the cap holder 15*e* in this alternative structure can be further lifted due to the elasticity of the elastic member 15*f*, even after the caps 15*b* cover the ink nozzles 10*a*-10*d*.

The positional state of the caps 15*b* and the protruding portion 15*g* with respect to the position of the cap holder 15*e* is set as below. When the recording head 10 is positioned above the maintenance mechanism 15, the following positional state can be established by moving the cap holder 15*e* upward and downward by means of the driving force of the drive motor 15*c*. (A) The caps 15*b* are moved away from the ink nozzles 10*a*-10*d* and the protruding portion 15*g* is spaced away from the lower communication hole 104*a* (see FIG. 3A). (B) The ink nozzles 10*a*-10*d* are covered by the caps 15*b* but the protruding portion 15*g* is spaced apart from the lower communication hole 104*a* (see FIG. 3B). (C) The ink nozzles 10*a*-10*d* are covered by the caps 15*b*, the protruding portion 15*g* is inserted into the lower communication hole 104*a*, and the communication hole 104 is covered by the cap holder 15*e* (see FIG. 3C).

According to the maintenance mechanism 15 constituted as above, the relative position of the ink nozzles 10*a*-10*d* with respect to the caps 15*b*, and the relative position of the lower communication hole 104*a* provided in the recording head 10 with respect to the protruding portion 15*g*, can be changed. Thus, the above-described positional states (A) to (C) can be realized for the caps 15*b* and the protruding portion 15*g* of the maintenance mechanism 15 with regard to the ink nozzles 10*a*-10*d* and the communication hole 104 of the recording head 10.

In the maintenance mechanism 15, when the ink nozzles 10*a*-10*d* are covered by the caps 15*b*, ink can be drawn from the sets of ink nozzles 10*a*-10*d* through the caps 15*b* and the cap holder 15*e* by a suction pump 112 (not shown in FIG. 2, see FIG. 3A). The drawn ink can be conveyed into a waste ink container 113 (not shown in FIG. 2, see FIG. 3A). When the communication hole 104 is covered by the cap holder 15*e*, ink containing air bubbles can be drawn from the tank body 102 of the sub-tank 101 and conveyed into the waste ink container 113.

[Structure of Control Processing Device 70 (Control System of Printer 3)]

Figure 5:
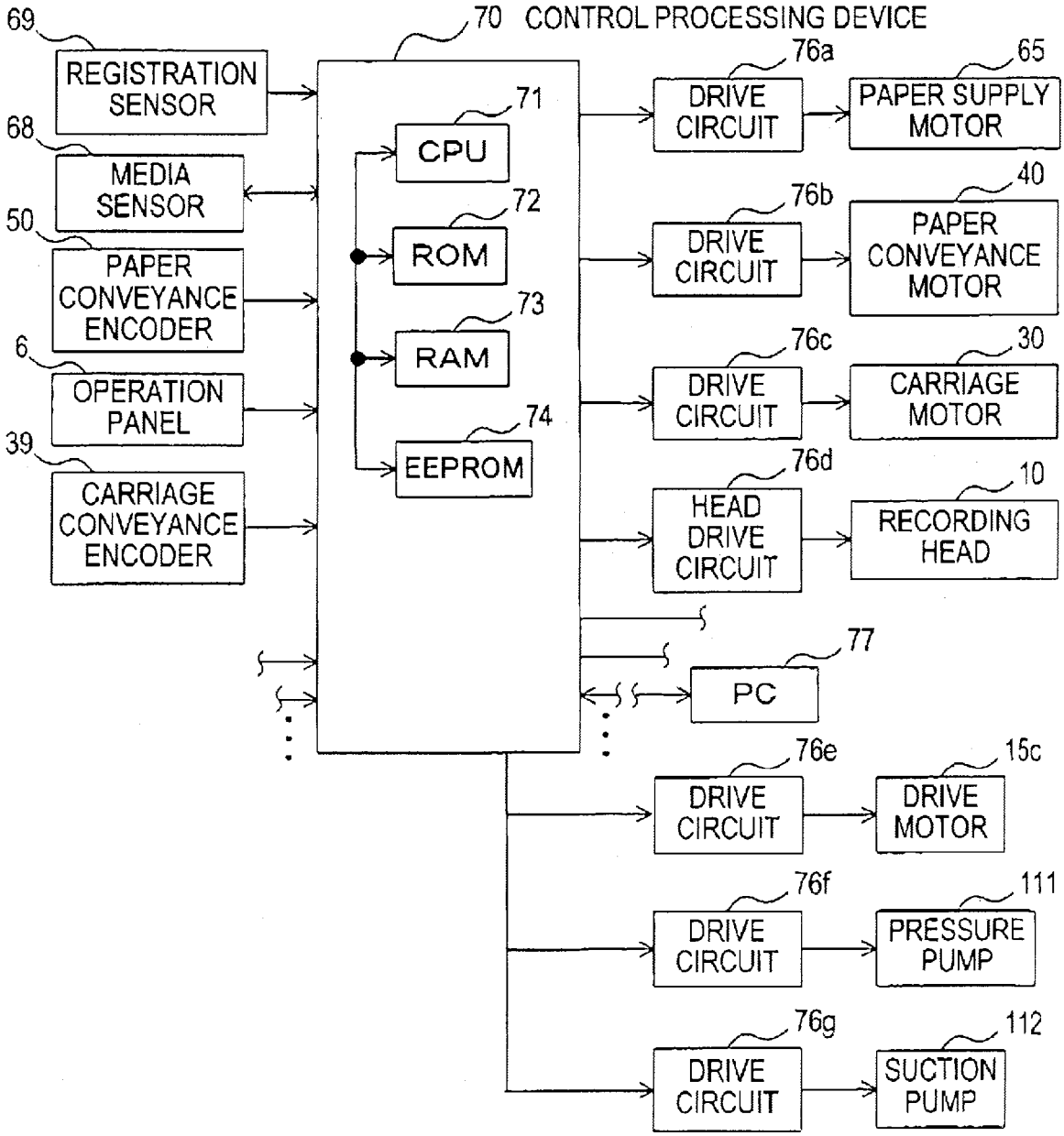
FIG. 5 is a block diagram showing a schematic structure of a control processing device according to a first embodiment.

Referring now to FIG. 5, the control processing device 70 comprises a microcomputer provided with a CPU 71, a ROM 72, a RAM 73 and an EEPROM 74. The registration sensor 69, the media sensor 68, the paper conveyance encoder 50, the operation panel 6, and the carriage conveyance encoder 39 are electrically connected to the control processing device 70.

Additionally, drive circuits 76*a*-76*c* for respectively driving the paper supply motor 65, the paper conveyance motor 40, and the carriage motor 30, a head drive circuit 76*d* for driving the recording head 10, and drive circuits 76*e*-76*g* for respectively driving the drive motor 15*c* of the maintenance mechanism 15, the pressure pump 111, and the suction pump 112, are all electrically connected to the control processing device 70. A personal computer (PC) 77 can be also connected to the control processing device 70.

When the control processing device 70 (more particularly, the CPU 71) receives instructions for recording on paper P from the PC 77 or from other functioning units, such as the copier unit or the facsimile unit etc. in the multifunction apparatus 1, a paper end detection process to detect the end position of the paper P is firstly performed. Then, based upon the detection result, a recording process is performed wherein image formation is conducted on the paper P. If further recording on a next page is needed, the paper end detection process and the recording process are performed for a next page. If recording on a next page is not necessary, the process is ended. In this manner, image forming onto paper P is performed The paper end detection process and the recording process herein follow the well-known art. Therefore, these processes are not described here in detail.

The control processing device 70 can change the relative position of the sets of ink nozzles 10*a*-10*d* of the recording head 10 with respect to the caps 15*b*, and the relative position of the lower communication hole 104*a* provided in the recording head 10 with respect to the protruding portion 15*g*, by driving the drive motor 15*c* through the drive circuit 76*e* so as to move the cap holder 15*e* up and down. Consequently, the positional state of the sets of ink nozzles 10*a*-10*d* and the communication hole 104 of the recording head 10 with respect to the caps 15*b* and the protruding portion 15*g* of the maintenance mechanism 15 can be changed into one of the above-described states (A) to (C). Moreover, the control processing device 70 can drive the pressure pump 111 via the drive circuit 76*f* so that four colors of ink can be supplied from the cartridges 21*a*-21*d* to the sub-tanks 101*a*-101*d* of the recording head 10. Furthermore, the control processing device 70 can drive the suction pump 112 via the drive circuit 76*g* so that ink can be drawn from the sets of ink nozzles 10*a*-10*d* through the caps 15*b* and the cap holder 15*e* and conveyed into the waste ink container 113.

[Operation of Maintenance Mechanism 15]

The operation of the maintenance mechanism 15 conducted by the control processing device 70 is described with reference to FIGS. 3A through 4B.

When the recording head 10 is on standby, the carriage motor 30 is driven so as to move the carriage 11 such that the recording head 10 is located above the maintenance mechanism 15. The drive motor 15*c* is driven to lift the cap holder

15*e*. As a result, the sets of ink nozzles 10*a*-10*d* are covered by the caps 15*b*. Also, the communication hole 104 is closed due to the position of the protruding portion 15*g* apart from the lower communication hole 104*a* (standby mode, see FIGS. 3B and 4A).

For conducting image recording on paper, the drive motor 15*c* is driven so as to lower the cap holder 15*e*. As a result, the caps 15*b* are moved away from the sets of ink nozzles 10*a*-10*d* and the sets of ink nozzles 10*a*-10*d* are brought into an open state. Also, the communication hole 104 is closed due to the position of the protruding portion 15*g* away from the lower communication hole 104*a* (recording mode, see FIGS. 3A and 4A). Then, the above-described paper edge detection process and the recording process are performed while the carriage 11 is moved in the left-to-right direction by the driving of the carriage motor 30.

In order to recover the discharge performance of the recording head 10, the carriage motor 30 is driven so as to move the carriage 11. As a result, the recording head 10 is positioned above the maintenance mechanism 15. The drive motor 15*c* is then driven. Consequently, the cap holder 15*e* is lifted so that the sets of ink nozzles 10*a*-10*d* are covered by the caps 15*b*, but the protruding portion 15*g* is apart from the lower communication hole 104*a*. The communication hole 104 is closed due to the position of the protruding portion 15*g* (discharge performance recovery mode, see FIGS. 3B and 4A). Subsequently, the suction pump 112 is driven so that ink is drawn from the sets of ink nozzles 10*a*-10*d*, through the caps 15*b* and the cap holder 15*e*, and conveyed into the waste ink container 113.

For discharging air from the sub-tank 101 of the recording head 10, the carriage motor 30 is driven so as to move the carriage 11. Consequently, the recording head 10 is positioned above the maintenance mechanism 15. The drive motor 15*c* is driven so as to lift the cap holder 15*e*. As a result, the sets of ink nozzles 10*a*-10*d* are covered by the caps 15*b*. Also, the communication hole 104 is opened due to the position of the protruding portion 15*g* having been inserted into the lower communication hole 104*a* (air discharge mode, see FIGS. 3C and 4B). The suction pump 112 is then driven so that ink containing air bubbles is drawn from the tank body 102 of the sub-tank 101 though the communication hole 104, which is covered by the cap holder 15*e*. The drawn ink is conveyed into the waste ink container 113.

[Effect]

According to the multifunction apparatus 1 of the first embodiment, the recording head 10 mounted on the carriage 11 includes the communication hole 104. The protruding portion 15*g* is provided on the cap holder 15*e* of the maintenance mechanism 15. By changing the relative position of the recording head 10 with respect to the cap holder 15*e*, the state of the printer 3 is switched into the standby mode, recording mode, discharge performance recovery mode, or air discharge mode. The multifunction apparatus 1 can be configured with a simpler structure as compared to a conventional inkjet recording apparatus in order to switch the state of the recording head 10 to any of the recording state, purging state, standby state, and air discharge state.

Moreover, according to the multifunction apparatus 1 of the first embodiment, the caps 15*b* of the maintenance mechanism 15 are supported by an elastic member 15*f*. Therefore, the cap holder 15*e* can be lifted further, even after the sets of ink nozzles 10*a*-10*d* are covered by the caps 15*b*, due to the elasticity of the elastic member 15*f*. The lifting of the cap holder 15*e* is not disrupted by the caps 15*b* when the communication hole 104 of the recording head 10 is opened by the engagement of the protruding portion 15*g*.

Furthermore, the valve body 105 is provided inside of the air discharging unit 103. The valve body 105 changes the communication state of the communication hole 104 in relation to the outside air. The air discharging unit 103 can be closed when the communication hole 104 is blocked by the valve body 105. This structure can be useful when the multifunction apparatus 1 is maintained for a long period of time, such as for shipping.

Second Embodiment

In the above-described first embodiment, a suction pump 112 is provided separately from the pressure pump 111 and is connected to the caps 15*b*. In the discharge performance recovery mode, ink is drawn from the sets of ink nozzles 10*a*-10*d*, which are covered by the caps 15*b*, through the caps 15*b* and the cap holder 15*e* by the negative pressure applied by the suction pump 112. In the air discharge mode, ink containing air babbles is drawn from the tank body 102 of the sub-tank 101 through the communication hole 104, which is covered by the cap holder 15*e*. However, in the second embodiment, a separate suction pump 112 is not provided. The waste ink container 113 is directly connected to the cap holder 15*e*, as shown in FIG. 6.

In the second embodiment with the above-described structure, the control processing device 70 operates the maintenance mechanism 15 as follows.

When the recording head 10 is on standby, the operation of the control processing device 70 is conducted in the same manner as in the first embodiment. That is, the carriage motor 30 is driven so as to move the carriage 11. Consequently, the recording head 10 is located above the maintenance mechanism 15. The drive motor 15*c* is driven so as to lift the cap holder 15*e*. As a result, the sets of ink nozzles 10*a*-10*d* are covered by the caps 15*b*. Also, the communication hole 104 is closed due to the position of the protruding portion 15*g* apart from the lower communication hole 104*a* (standby mode, see FIGS. 6B and 4A).

For conducting image recording on paper, the operation of the control processing device 70 is conducted in the same manner as in the first embodiment. That is, the drive motor 15*c* is driven so as to lower the cap holder 15*e*. As a result, the caps 15*b* are moved away from the sets of ink nozzles 10*a*-10*d* and the sets of ink nozzles 10*a*-10*d* are brought into an open state. Also, the communication hole 104 is closed due to the position of the protruding portion 15*g* apart from the lower communication hole 104*a* (recording mode, see FIGS. 6A and 4A). Subsequently, the above-described paper edge detection process and the recording process are performed while the carriage 11 is moved in the left-to-right direction by the driving of the carriage motor 30.

In order to recover the discharge performance of the recording head 10, the carriage motor 30 is driven so as to move the carriage 11. Consequently, the recording head 10 is located above the maintenance mechanism 15. The drive motor 15*c* is driven so as to lift the cap holder 15*e*. As a result, the sets of ink nozzles 10*a*-10*d* are covered by the caps 15*b*. However, the communication hole 104 is closed due to the position of the protruding portion 15*g* apart from the lower communication hole 104*a* (discharge performance recovery mode, see FIGS. 6B and 4A). Up to this point, the operation of the control processing device 70 is conducted in the same manner as in the first embodiment. Subsequently, the pressure pump 111 is driven so that ink is discharged from the sets of ink nozzles 10*a*-10*d*, and conveyed into the waste ink container 113 through the caps 15*b* and the cap holder 15*e*.

For discharging air from the sub-tank 101 of the recording head 10, the carriage motor 30 is driven so as to move the carriage 11 Consequently, the recording head 10 is located above the maintenance mechanism 15. The drive motor 15*c* is driven so as to lift the cap holder 15*c*. As a result, the sets of ink nozzles 10*a*-10*d* are covered by the caps 15*b*. The communication hole 104 is opened due to the position of the protruding portion 15*g* having been inserted into the lower communication hole 104*a* (air discharge mode, see FIGS. 6C and 4B). Up to this point, the operation of the control processing device 70 is conducted in the same manner as in the first embodiment. Subsequently, the pressure pump 111 is driven so that ink containing air bubbles is discharged from the tank body 102 of the sub-tank 101 though the communication hole 104, which is covered by the cap holder 15*c*, and conveyed into the waste ink container 113.

The same effect as in the first embodiment can be attained by the structure of the second embodiment described above.

Although some embodiments of the present invention are described above, the present invention is not limited to these embodiments. Variations and modifications are possible within the scope of the invention.

What is claimed is:

1. An inkjet recording apparatus comprising:

a recording head that includes a sub-tank therein for storing ink and an ejection nozzle for conducting image recording on a recording medium by selectively ejecting the ink stored in the sub-tank therefrom, the sub-tank being provided with an air discharging unit having a communication hole that allows communication of an interior of the sub-tank with atmospheric air;

a carriage that is equipped with the recording head and is capable of being reciprocated in a direction perpendicular to a conveyance direction of a recording medium;

a movable body that includes a nozzle cap for covering a nozzle surface for the ejection nozzle of the recording head, the movable body being disposed so as to face the air discharging unit of the sub-tank and provided with an open-close switching member so as to switch a state of the communication hole between an open state and a close state corresponding to a change of a relative position of the nozzle surface with respect to the movable body;

a moving mechanism that can change the relative position of the nozzle surface with respect to the movable body by moving the movable body; and a relative position controller that controls the moving mechanism for moving the movable body so as to change the relative position of the nozzle surface with respect to the movable body, the relative position controller switching a state of the inkjet recording apparatus into:

a recording mode wherein the nozzle cap is located away from the nozzle surface and the communication hole is closed so as to allow image recording on a recording medium;

a discharge performance recovery mode wherein the nozzle surface is covered by the nozzle cap and the communication hole is closed so as to allow recovery of discharge performance of the recording head; and an air discharge mode wherein the nozzle surface is covered by the nozzle cap and the communication hole is opened so as to allow discharge of air in an interior of the sub-tank.

2. The inkjet recording apparatus as set forth in claim 1 wherein the movable body comprises an elastic member that has elasticity and supports the nozzle cap.

3. The inkjet recording apparatus as set forth in claim 1 wherein the air discharging unit comprises a valve body that allows communication of the interior of the sub-tank with atmospheric air through the communication hole when the valve body is engaged with the open-close switching member, and does not allow communication with atmospheric air when the valve body is apart from the open-close switching member.

* * * * *